United States Patent [19]

Zieg et al.

[11] 4,126,915

[45] Nov. 28, 1978

[54] APPARATUS FOR STRIPPING CARD FLATS AND THE LIKE

[75] Inventors: Stanley W. Zieg, Greenville; John P. Hill, Jr., Taylors; John S. McCrary, Greenville, all of S.C.

[73] Assignee: John D. Hollingsworth on Wheels, Inc., Greenville, S.C.

[21] Appl. No.: 847,416

[22] Filed: Oct. 31, 1977

[51] Int. Cl.[2] ..... D01G 15/76

[52] U.S. Cl. ..... 19/111; 19/109

[58] Field of Search ..... 19/107, 109, 110, 111

[56] References Cited

FOREIGN PATENT DOCUMENTS 548,777 10/1922 France ..... 19/109

*Primary Examiner*—Dorsey Newton

*Attorney, Agent, or Firm*—Bailey, Dority & Flint

[57] ABSTRACT

An apparatus is illustrated which is especially useful for cleaning the flats of a textile carding machine wherein a rotatable suction conduit has circumferentially spaced slots therein which are successively exposed in cleaning relation to successive flat or carding surfaces by means of a substantially imperforate flexible cover sheet extending about the rotatable suction conduit, being fixed on one end so that the cover extends as a shroud preferably extending in the direction of rotation of the conduit away from the fixed end so as to leave an opening between opposed ends of the shroud. The shroud covers the slots rendering them inactive so that only that slot portion between opposed ends of the shroud actively exert suction. Thus, the suction is concentrated at a specific area, between the ends of the cover, adjacent a limited portion of a flat while permitting rotation of the suction conduit without buildup of excessive lint accumulation as to interfere with the operation of the conduit.

5 Claims, 2 Drawing Figures

APPARATUS FOR STRIPPING CARD FLATS AND THE LIKE

BACKGROUND OF THE INVENTION

Efforts have been made in the past to utilize suction in addition to the more conventional methods for stripping the flats of a textile carding machine. For example, British Pat. No. 148,614 of July 22, 1920 illustrates the use of two tubes or shells, one arranged within the other, the inner shell being a suction conduit having circumferentially spaced slots which are successively exposed to a slotted opening within the outside shell to concentrate the force of the suction. In this patent, the suction is concentrated between the carding surface of the main cylinder and the doffer. The difficulty with this sort of arrangement is that lint, trash and the like accumulates between the relatively rotating shells making for inefficiency in operation, damage to the parts, as well as the necessity for excessive cleaning and maintenance. Another similar device is shown operating in connection with the flats in French Pat. No. 548.777 of Jan. 25, 1923. U.S. Pat. No. 3,604,061 illustrates the use of a more conventional brush positioned adjacent the forward end of conventional flats over the doffer. In this instance, a plenum arrangement is also employed to collect flat strips dislodged by the brush.

Various flat arrangements have been employed in the past in addition to the conventional wherein one set of flats turns relatively slow in a direction opposed to the direction of rotation of the main cylinder. Variations include the use of two sets of flats as, for example, where a first set of flats extends from adjacent the lickerin over a portion of the main cylinder to a point where a second and usually more extensive set of flats fills out the remaining area normally occupied by a conventional flat system.

Accordingly, it is an important object of this invention to provide an improved suction apparatus for cleaning carding surfaces which is especially useful in connection with stripping card flats.

Another important object of the invention is to provide an improved flat stripping apparatus which will require a minimum of maintenance and which will itself require cleaning less often.

Another important object of the invention is to provide an improved flat stripper wherein suction forces are concentrated and wherein fouling as a result of line and flat strip accumulations is minimized.

BRIEF DESCRIPTION OF THE INVENTION

It has been found that an apparatus for cleaning the flats and other surfaces of a textile carding machine may be provided by covering a rotatable suction conduit having circumferentially spaced slots therein with a flexible substantially imperforate shroud which is fixed against rotation adjacent one end thereof so as to successively expose the flats to a concentrated suction action.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figures 1, 2:
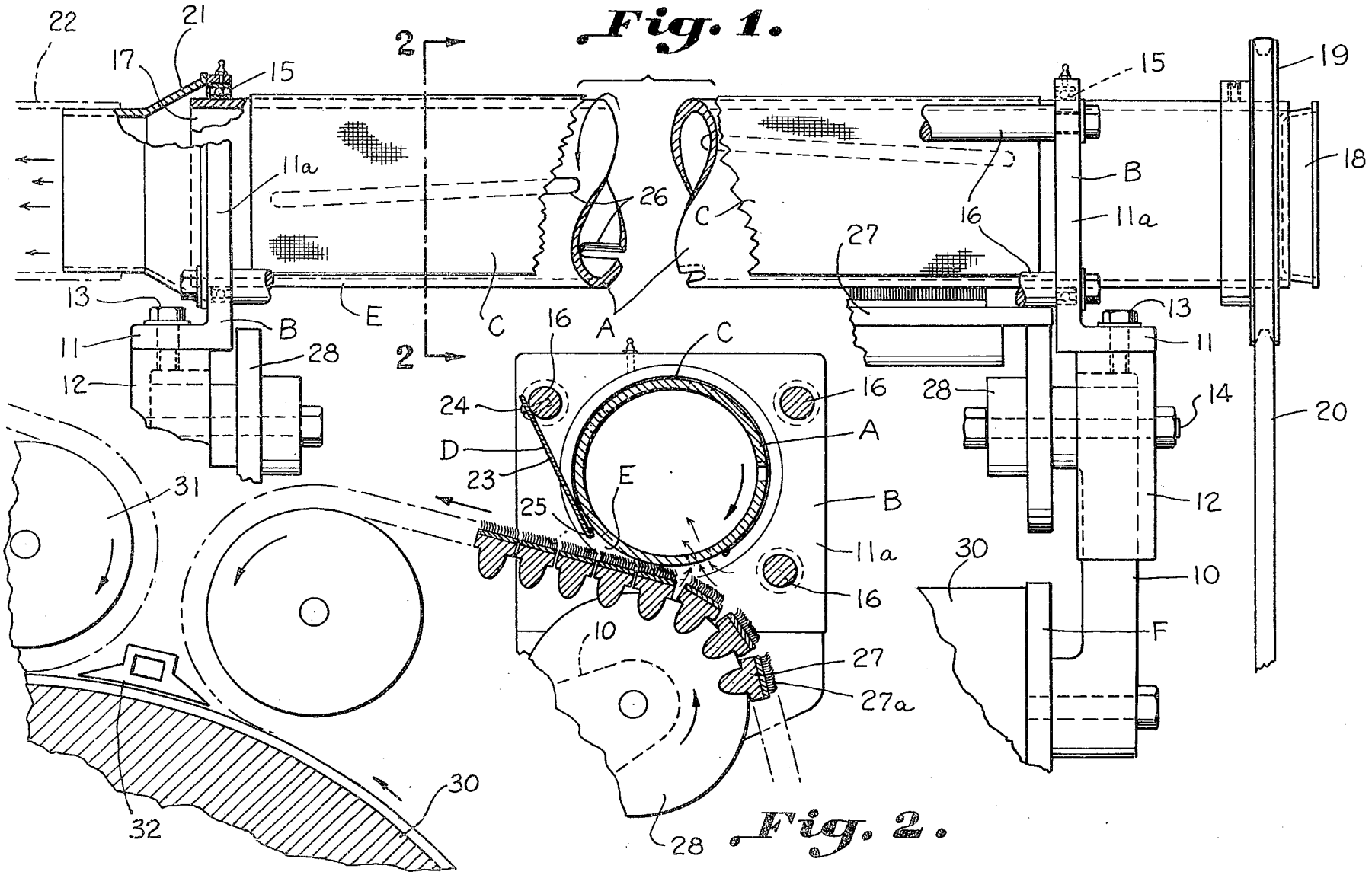
FIG. 1 is a front elevation with parts omitted and parts broken away illustrating a flat stripping apparatus constructed in accordance with the present invention on the frame members of a card in position to strip the flats.
FIG. 2 is a transverse sectional elevation taken on the line 2—2 of FIG. 1 further illustrating the suction apparatus constructed in accordance with the present invention positioned adjacent a first set of card flats in stripping relation thereto.

The drawing illustrates apparatus for stripping the flats of a textile carding machine. A rotatable suction conduit A has a plurality of circumferentially spaced suction slots therein. A fixed support B carries the suction conduit for rotation in superposed relation to the flats. A flexible substantially imperforate shroud C extends about the conduit in superposed relation thereto. Means D restrain an end of the flexible shroud in fixed relation to the fixed support. An opening E is defined by the flexible shroud presenting between opposed ends thereof a slot in the suction conduit in juxtaposed relation to successive flats for stripping the flats.

A textile carding machine which includes end frame members F carries the rotatable suction conduit or shell A. Fixed supports B are provided in the form of L-shaped brackets 11 which are carried on base support members 12 as by suitable fastening means in the form of bolts 13. The base supports 12 are positioned upon stands carried by the frame F. The bolts 14 have bearing portions for mounting idler wheels for rotation as described below.

The brackets 11 have opposed openings therein which carry suitable bearings 15 for supporting the rotatable suction conduit A adjacent each end thereof. A plurality of longitudinal supports include bars 16 extending between the legs **11*a* of the brackets 11. One end of the rotatable suction conduit A is open as illustrated at 17 while the other end is closed by a plug 18. The end of the conduit adjacent the plug has a sheave 19 which is driven by a driven belt 20 from a suitable motor (not shown) carried adjacent the card frame members F. The open end of the rotatable suction conduit A is provided with a fitting 21 which is suitably fixed in sealing engagement about the opening within the adjacent vertical leg 11*a* of the bracket 11 exteriorly of the bearings 15. The fitting is connected to a suitable source of suction (not shown) as by a hose 22**.

A flexible substantially imperforate shroud extends about the suction conduit in superposed relation thereto. The shroud may be of cloth or any desired flexible sealing sheet material which is not excessively porous. A sheet of flexible vinyl covered woven cloth having a low coefficient of friction is preferred. The shroud is sucked into sealing engagement about the rotatable conduit or duct A by the air slots except for a slot in active suction relation adjacent a flat between opposed ends thereof.

The means D for restraining the shroud includes a bracket support 23 secured on one end as by screws 24 to one of the longitudinal supports 16. The bracket 23 extends toward the rotatable suction conduit A and has a gripping portion 25 for fixing one end of the shroud C for restraining it in fixed position with respect to the fixed support B. The shroud preferably overlies and engages the rotatable conduit extending away from the restraining means D in the direction of rotation, as illustrated, and defines an open area E between opposed ends thereof so as to permit successive slots 26 within the rotatable suction conduit to be exposed to successive flats. It will be observed, that the slots 26 may be spaced longitudinally of the conduit and are also spaced peripherally so as to progressively engage successive longitudinal portions of successive flats during the carding operation.

As illustrated in FIG. 2, a number of flats 27 carry the usual card clothing 27*a*. These flats are mounted upon an idler wheel 28 which, in turn, is carried by the bracket members 10 adjacent the card cylinder 30.

As illustrated, a first series of flats is carried for movement adjacent the main cylinder of the carding machine in a direction opposed to the direction of rotation of the main cylinder. It is preferred that a second set of flats 31, rotating in the usual fashion are provided successively thereto and occupy a major area in which flats are normally employed. A means 32 of removing trash and short fiber may be placed between the two sets of flats. Such means may be of the type described in U.S. Pat. No. 3,858,276. The first of the flats may be of relatively limited extent and remove the greater portion of the gross trash and short fibers so that the second set of flats may provide a finishing operation wherein a greater extent of the trash and short fibers may be removed.

It will also be noted that the slots 26 are preferably inclined somewhat from the longitudinal axis of the suction conduit having the effect of lifting one end of the strip and then pealing the remainder off of that portion of the flat exposed to the suction action of that given slot. Thus, a tendency of the flat strips to bridge successive slots is minimized and a maximized suction force may be progressively exerted across given areas of card flat.

While a preferred embodiment of the invention has been described using specific terms, such description is for illustrative purposes only, and it is to be understood that changes and variations may be made without departing from the spirit or scope of the following claims.

What is claimed is:

1. Apparatus for stripping the flats and the like of a textile carding machine comprising:

a rotatable suction conduit having a plurality of circumferentially spaced suction slots therein;

fixed support carrying said suction conduit for rotation in superposed relation to said flats;

a flexible substantially imperforate shroud extending in sealing engagement (about) along said conduit in superposed relation thereto responsive to the suction exerted by said suction slots on said shroud;

means restraining at least one end of said flexible shroud in relation to said fixed support permitting rotation of the conduit within the shroud; and an opening defined by said flexible shroud presenting between opposed ends thereof a slot in said suction conduit in juxtaposed relation to successive flats for stripping the flats.

2. The structure set forth in claim 1, wherein said flexible shroud is a sheet of textile material.

3. The structure set forth in claim 1, wherein a plurality of said slots are spaced longitudinally of said suction conduit.

4. The structure set forth in claim 3, wherein said slots are inclined at an angle to the longitudinal axis of said suction conduit.

5. The structure set forth in claim 1, wherein said flats include a first series of flats carried for movement adjacent a main cylinder of said carding machine.

* * * * *